US006815147B2

(12) United States Patent
Fischer

(10) Patent No.: US 6,815,147 B2
(45) Date of Patent: Nov. 9, 2004

(54) FILM WHICH CAN BE INSCRIBED BY A LASER BEAM

(75) Inventor: Sven Fischer, Munich (DE)

(73) Assignee: Schreiner GmbH & Co., KG, Oberschleissheim (DE)

( * ) Notice: Subject to any disclaimer, the term of this patent is extended or adjusted under 35 U.S.C. 154(b) by 0 days.

(21) Appl. No.: 10/398,901

(22) PCT Filed: Oct. 12, 2001

(86) PCT No.: PCT/EP01/11840

§ 371 (c)(1),
(2), (4) Date: Sep. 17, 2003

(87) PCT Pub. No.: WO02/30677

PCT Pub. Date: Apr. 18, 2002

(65) Prior Publication Data

US 2004/0048172 A1 Mar. 11, 2004

(30) Foreign Application Priority Data

Oct. 12, 2000 (DE) ..... 200 17 501 U

(51) Int. Cl.[7] ..... B41M 5/24

(52) U.S. Cl. ..... 430/293; 430/292; 430/346; 430/945; 283/85; 283/101

(58) Field of Search ..... 430/292, 293, 430/297, 346, 945; 283/85, 101

(56) References Cited

U.S. PATENT DOCUMENTS 6,066,437 A * 5/2000 Kosslinger ..... 430/297

FOREIGN PATENT DOCUMENTS

WO WO 98 16397 4/1998

* cited by examiner

*Primary Examiner*—John A. McPherson
(74) *Attorney, Agent, or Firm*—Donald R. Studebaker; Nixon Peabody, LLP

(57) ABSTRACT

The laser beam ablatable film of the invention includes an ablatable metallic layer arranged below a translucent protective layer that is dyed through-out. The metallic layer is connected to a contrastive colored layer by a transparent connecting layer, and the contrastive colored layer is connected to a plastic film. The entire assemblage of laminated layers can also include a self-adhesive film applied to the plastic film and the self-adhesive layer is then covered by a removable carrier material. This laminated assembly can be stamped into individual labels that can be detached from the carrier material and placed onto objects. When the ablatable foil of the invention is subjected to a laser beam surface areas of the laminated assembly appear as a mixture of colors of letters or symbols resulting from the color filter effect of the protective film.

14 Claims, 2 Drawing Sheets

FILM WHICH CAN BE INSCRIBED BY A LASER BEAM

BACKGROUND OF THE INVENTION

1. Field of the Invention

The present invention relates to a film that can be inscribed by a laser beam, which has at least one protective layer than is substantially penetrable by a laser beam, on whose underside a medium that is changeable by the laser beam is arranged, whereby the medium that is changeable by the laser beam has an opaque layer that is ablatable by the laser beam and at least one contrastive colored layer that is substantially resistant to the laser beam.

By "inscribing", it is to be understood that what is meant are graphical symbols and characters of each type. The protective layer can be a plastic film, a protective lacquer layer, or the like, for example.

2. Description of Related Art

A film of this type is known from the international disclosure WO98/16397. The medium that is changeable by laser beam of the known film has a contrastive layer with coloration under a metallic layer that is ablatable by means of the laser beam, the metallic layer having a coloration or dye that is different from that of the contrastive layer. By "ablation", what is to be understood is, therefore, the erosion or destruction of a layer, which thereby loses its opaqueness.

If surface components in the form of letters or graphical symbols are ablated by laser action on the metallic layer, these characters are recognizable in the color or dye of the contrastive layer through the protective layer, while the non-ablated region remains visible in the dye of the metallization. The laser action takes place from the side of the protective layer through the protective film.

Of course, one remains limited with the use of the inscribable film according to the type of the film described in WO09/16397, which relates to the colored appearance, as far as one wishes to justifiably maintain the manufacturing expense: The ablated region appears through the protective layer in the color of the contrastive layer, the non-ablated region in the color of the metallization. With the commonly used metallization, generally black or silver white metallization takes place. Therefore, the possible inkings that are available are white or varicolored inscription with a black background or black or multicolored inscription with a silver white background. Indeed, other colors of metallization are contemplated in principle, however, if the colors available for supply, in particular, when one takes into consideration the price of many "varicolored" metals or their application as a thin layer, one is limited to a minimal number from which to choose. Simple color printing of the protective layer is eliminated in most, since film that can be inscribed by laser is used in a first line there, where one, on the basis of the durability against abrasion or bleaching out, must grant exception to printed films.

The invention, subsequently, is based on the problem of producing a film that can be inscribed with a laser beam, which offers a large choice of colors. To this purpose, the positive qualities of common laser-inscribable films should be retained. This means that with inscription with the laser beam, practically no health endangering and environmentally damaging emissions should be produced, and the prepared, inscribed labels, identification plates, etc., should offer large, imminent protection of the lettering relative to chemical and mechanical specifications, that is, among other considerations, a good durability against wear and bleaching out.

SUMMARY OF THE INVENTION

The problem is resolved with a film that can be inscribed by a laser beam, which has at least one protective layer that is substantially penetrable by a laser beam, on whose under side, a medium that is changeable by the leaser beam is arranged, which has an opaque layer that is ablatable by the laser beam and at least one contrastive layer that is substantially resistance against the laser beam, whereby at least one of the protective layers to be substantially penetrated by the laser beam is dyed through. Therewith, the color impression of the layer visible through the protective layer is affected by the coloring of the protective layer. For example, the non-ablated part of a silver white metallization appears gold-colored through a yellow, dyed-through protective layer.

In one advantageous further embodiment of the invention, the medium that is changeable by the laser beam has at least one further, opaque layer than is ablatable by the laser beam. In this manner, a translucent, dyed-through layer (that is, a substantially penetrable and substantially transparent layer for the laser beam) is arranged between the layers that are ablatable by the laser beam. This allows realization of also sectionally, multicolored inscribing with one and the same foil, whereby the writing color also can be varied first upon the inscribing process itself, as the case may be, if one removes none, multiple, or all superimposed, associated ablatable layers at a selected point.

It is advantageous if at least one of the opaque layers that is ablatable by the laser beam is predominantly metallic. In this manner, the metallization can be steamed on or sputtered, for example, on translucent film. Preferably, the metallic layers are aluminum layers.

In a further embodiment of the invention, at least one of the ablatable layers contains metal oxide, whereby also non-stoichiometric metal oxides and mixtures of metals and metal oxides can be contained.

In a further embodiment of the present invention, the contrastive layer includes multiple regions of differing colors or dyes.

In a particularly preferred embodiment of the present invention, the medium that is changeable by the laser beam has a self-adhesive layer on its under side, whereby the inscribed film can be mounted in a simple manner on a support surface. Preferably, the film previously is arranged on a carrier course coated with an adhesive, from which the film can be pulled before application on the support surface.

In a further advantageous embodiment, the protective layer is provided on its upper side with an adhesive layer, whereby it is suited for use as a rear glass, for example, in automobile rear windows.

Additional adaptations of the visual operation of the present invention can be achieved, in which one prints or lacquers the protective layer at least partially.

In a particularly preferred embodiment of the present invention, the film has stampings, which subdivides the film into individual surface regions, for example, individual character labels, identification plates, or placards. The surface regions, then, can be detached in an advantageous manner and, for example, mechanically mounted on objects to be designated.

In a further advantageous embodiment of the present invention, the film is mountable onto a support surface and has additional safety stampings, which makes impossible undesired removal of the film from the support without at least a partial destruction of the film.

In a further embodiment of the present invention, the film is subdivided by action of a laser beam into individual, at least partially detachable surface regions.

Next, the invention will be described in more detail with reference to the schematically represented embodiments. The illustrations should explain the layer structure of the inventive embodiments, whereby the dimensions are not reproduced according to scale.

DETAILED DESCRIPTION OF THE INVENTION

Figure 1:
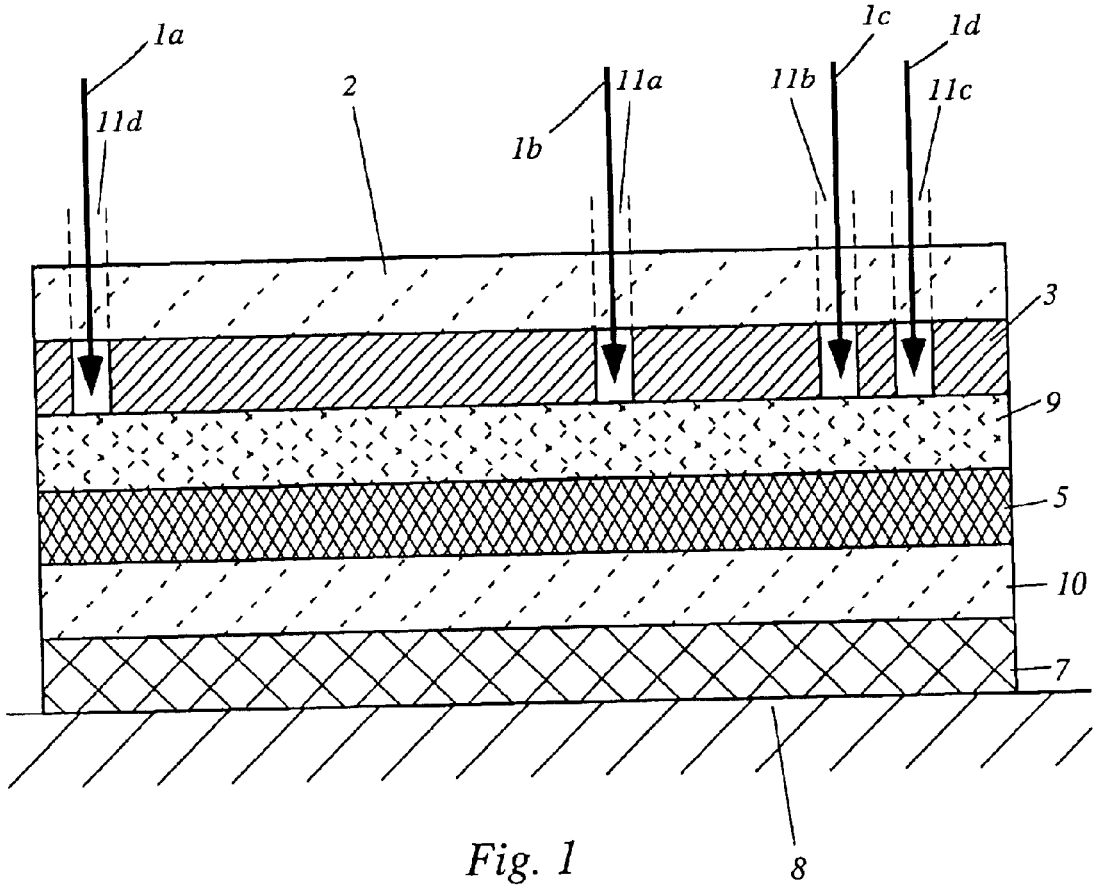
FIG. 1: a schematic sectional representation of the film of the present invention with an ablatable layer.

In FIG. 1, a not-to-scale section perpendicular to the layer structure of an embodiment of the present invention is schematically illustrated. Beneath the translucent, dyed-through protective layer 2, an ablatable, metallic layer 3 is arranged, which is connected with the contrastive colored layer 5 via a transparent connecting layer 9, the contrastive colored layer being mounted on a plastic or synthetic film 10. The protective layer 2, according to its intended purpose, likewise is made of plastic. On its under side, the plastic film 10 has a self-adhesive layer 7, which is covered with a carrier material 8 on the side opposite to the plastic film, the carrier material 8, for example, a part of a carrier material moving through a path or course. The carrier material 8 has an adhesive that is applied through a corresponding treatment, for example, a siliconization, so that the laser-inscribable film can be pulled from the carrier material 8 and can be adhered to a different support surface. If the film laminate is first cut or stamped into individual labels, placards, plates, etc., then these labels, placards, plates, etc., are individually detachable from the carrier material 8 and can be adhered to various objects in a simple manner.

With the assistance of a laser beam 1*a*, 1*b*, 1*c*, 1*d*, for example, from an electronic, follow-up YAG-laser, surface regions 11*a*, 11*b*, 11*c*, 11*c* of the metallic layer 3 illustrated with letters or graphical characters can be ablated. This appears, then, in a mixed color, which results from the color-filter effect of the protective layer 2 from the color of the contrastive layer 5. The non-ablated regions appear in a color, which results from the color of the metallizing 3 with the color-filter action of the protective layer 2. With brighter, adequate coloration of the protective layer 2, the color impression of a darkly colored contrastive layer 5 is only slightly or not at all affected. In the event of a silver white metallization 3, a black contrastive layer 5, and a greenish dyed-through protective layer 2, a black lettering with a green-metallic colored background is provided. For the case of a silver white metallization 3, a dark blue contrastive layer 5 and a yellow, dyed-through protective layer 2 produces a dark blue lettering with a gold-colored background.

Figure 2:
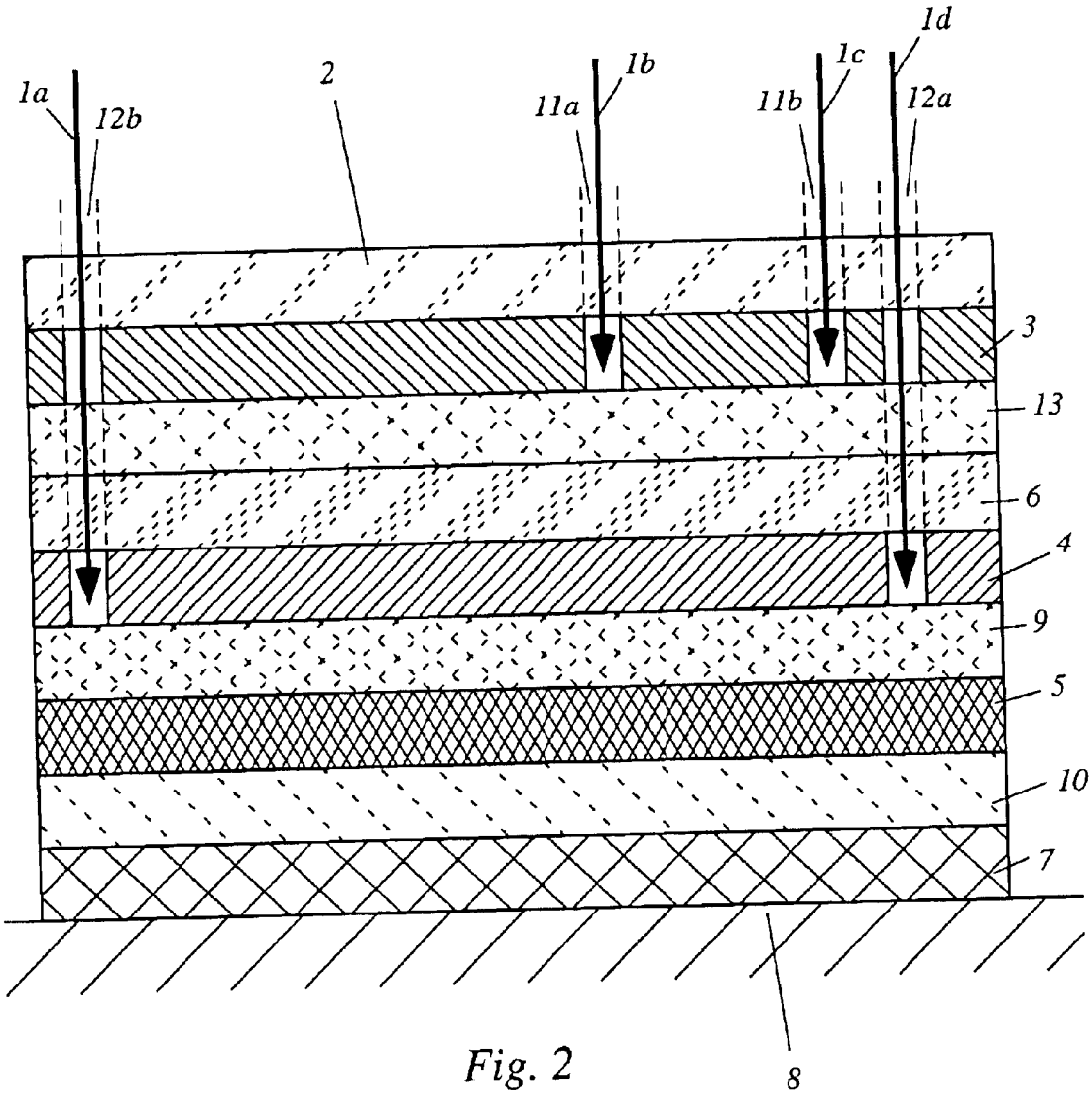
FIG. 2: a schematic sectional representation of a film of the present invention with two ablatable layers.

In FIG. 2, a further embodiment of the present invention is represented in a not-to-scale section perpendicular to the layer structure. Beneath the translucent, dyed-through protective layer 2, an ablatable metallic layer 3 is arranged, which is connected with a dyed-through, translucent layer 6 by means of a transparent, isolating layer 13. On the underside of the translucent layer 6, a second ablatable layer 4 is arranged. The dyed-through, translucent layer 6 comprises plastic, and the second ablatable layer 4 is made from metal.

The second ablatable layer 4 is connected with the contrastive colored layer 5 via a transparent connecting layer 9, which is mounted on a plastic film 10. The protective layer 2 is likewise made from plastic. On its underside, the plastic film 10 has a self-adhesive layer 7, which is covered on the side opposite the plastic film with a carrier material 8, for example, a part of a carrier material moving through a path. The carrier material 8 has an adhesive that is applied through a corresponding treatment, for example, a siliconization, so that the laser-inscribable film can be pulled from the carrier material 8 and can be adhered to a different support surface. If the film laminate is first cut or stamped into individual labels, placards, plates, etc., then these labels, placards, plates, etc., are individually detachable from the carrier material 8 and can be adhered to various objects in a simple manner.

With the assistance of a laser beam 1*b*, 1*b*, for example, from an electronic, follow-up YAG-laser, surface areas illustrated with letters or graphical characters 11*a*, 11*b* of the metallic layer 3 can be ablated through a corresponding selection of the power and operating time of the laser beam 1*b*, 1*c*, such that the second ablatable layer 4 is not also ablated. The ablated regions 11*a*, 11*b* appear in a color that is produced from the color of the metallization 4 with the color-filtering effect of the protective layer 2 and the translucent layer 6. The non-ablated regions appear in a color, which is produced from the color of the metallization 3 with the color-filter effect of the protective layer 2.

With the assistance of the laser beam 1*a*, 1*d* of the electronic, follow-up YAG-laser, paired, overlapping surface regions illustrated with letters or graphical characters of the metallic layers 3 and 4 are ablated, when the power and operating time of the laser beam 1*a*, 1*d* is correspondingly adjusted, or the laser beam 1*a*, 1*d* is guided twice over the corresponding regions 12*a*, 12*b*. The regions 12*a*, 12*b* appear, then, in a mixed coloration, which results by the color-filtering effect of the protective layer 2 and the translucent layer 6 from the color of the contrastive layer 5. With brighter, adequately transparent coloration of the protective layer 2 and translucent layer 6, the color impression of a darkly colored contrast layer 5 is only minimally affected or not affected at all.

In the event of a yellow, dyed-through protective layer 2, a translucent layer 6 in a bright cyan, dyed-through translucent layer, silver white metallization 3, 4, and a black contrastive layer 5, green-metallic colored and black characters with a gold-colored background are produced. In the case of a bright cyan, dyed-through protective layer, a yellow, dyed-through translucent layer 6, silver white metallization 3, 4, and a black contrastive layer 6, green-metallic colored and black characters with a cyan-metallic colored background are produced.

What is claimed is:

1. A film inscribable by a laser beam comprising:

at least one protective layer that is substantially penetrable by the laser beam;

a medium that is changeable by the laser beam arranged on an underside of the at least one protective layer;

wherein the medium that is changeable by the laser beam includes at least one opaque layer that is ablatable by the laser beam and at least one contrastive layer that is substantially resistant to the laser beam, and wherein the at least one of the at least one protective layer that is substantially penetrable by the laser beam is dyed through.

2. The film that is inscribable by a laser beam according to claim 1, wherein the medium that is changeable by means of the laser beam includes at least two opaque layers that are ablatable by the laser beam, and wherein, between the at least two opaque layers that are ablatable by the laser beam, a translucent, dyed-through layer is arranged.

3. The film that is inscribable by a laser beam according to claim 1, wherein the at least one opaque layer that is ablatable by the laser beam is a metallic layer.

4. The film that is inscribable by a laser beam according to claim 3, wherein the metallic layer is an aluminum layer.

5. The film that is inscribable by a laser beam according to claim 1, wherein the at least one opaque layer that is ablatable by the laser beam contains a metal oxide.

6. The film that is inscribable by a laser beam according to claim 1, characterized in that the contrastive layer includes multiple layers of different colors.

7. The film that is inscribable by a laser beam according to claim 1, characterized in that the medium that is changeable by the laser beam has a self-adhering layer disposed at least partially on an under side of the medium that is changeable by the laser beam.

8. The film that is inscribable by a laser beam according to claim 7, wherein the adhesive of the self-adhering layer is non-permanently adhered to a carrier material.

9. The film that is inscribable by a laser beam according to claim 1, wherein the protective layer has an adhesive layer on an upper side.

10. The film that is inscribable by a laser beam according to claim 1, wherein the protective layer is at least partially printed or lacquered.

11. The film that is inscribable by a laser beam according to claim 1, wherein the film has stampings which subdivide the film into individual surface regions.

12. The film that is inscribable by a laser beam according to claim 11, wherein the individual signal surface regions formed by the stampings are at least partially detachable.

13. The film that is inscribable by a laser beam according to claim 1, wherein the film is mountable on a support surface and includes safety stampings, wherein said safety stampings make impossible undesired detachment of the film from the support surface without at least partial destruction of the film.

14. The film that is inscribable by a laser beam according to claim 1, wherein the film is subdivided into individual, at least partially detachable surface regions, by operation of the laser beam which ablates the medium or a further laser beam.

* * * * *